US007360376B2

(12) United States Patent
Juntunen et al.

(10) Patent No.: US 7,360,376 B2
(45) Date of Patent: Apr. 22, 2008

(54) FUNCTION TRANSFORM SUB-BASE

(75) Inventors: Robert D. Juntunen, Minnetonka, MN (US); Peter E. Stolt, Crystal, MN (US); Guy M. Shoultz, Buffalo, MN (US)

(73) Assignee: Honeywell International Inc., Morristown, NJ (US)

( * ) Notice: Subject to any disclaimer, the term of this patent is extended or adjusted under 35 U.S.C. 154(b) by 241 days.

(21) Appl. No.: 10/448,936

(22) Filed: May 30, 2003

(65) Prior Publication Data

US 2004/0238651 A1 Dec. 2, 2004

(51) Int. Cl.
*F25D 19/00* (2006.01)
*H01R 12/00* (2006.01)
*H05K 7/00* (2006.01)

(52) U.S. Cl. ..... 62/298; 439/69; 361/760; 361/785; 361/792

(58) Field of Classification Search ..... 62/298, 62/127, 159, 160, 203, 179, 180; 236/10, 236/11, 1 E, 1 EA, 1 EB; 165/11.1, 240; 439/69, 525; 361/760, 761, 785, 792
See application file for complete search history.

(56) References Cited

U.S. PATENT DOCUMENTS 4,072,380 A * 2/1978 Freehauf ..... 439/525
4,401,353 A 8/1983 McDevitt, Jr. et al.
4,426,850 A * 1/1984 Reedy ..... 62/125
4,540,226 A * 9/1985 Thompson et al. ..... 361/761
4,609,241 A 9/1986 Peterson
4,788,520 A 11/1988 Strand
5,039,009 A * 8/1991 Baldwin et al. ..... 236/51
5,572,409 A 11/1996 Nathan et al.
5,726,482 A 3/1998 Nathan et al.
5,806,760 A * 9/1998 Maiello ..... 236/11
5,917,229 A 6/1999 Nathan et al.
5,920,731 A 7/1999 Pletl et al.
5,950,709 A * 9/1999 Krueger et al. ..... 165/11.1
6,000,458 A * 12/1999 Watanabe ..... 165/11.1
6,169,937 B1 1/2001 Peterson
6,445,242 B2 9/2002 Bloodworth et al.
6,888,441 B2 * 5/2005 Carey ..... 337/380

OTHER PUBLICATIONS http://www.precicontact.ch/uso%20so%20socket.htm, Dip Socket, pp. 1-4, Mar. 5, 2003.

(Continued)

*Primary Examiner*—Marc Norman

(57) ABSTRACT

Methods, devices and systems for coupling an HVAC controller to an HVAC system are provided. In several embodiments, a sub-base is provided allowing an HVAC controller to be coupled to a printed wire board to allow, in some cases, modification of the HVAC controller function. The sub-base may include a plurality of terminals, each terminal having a contact mating feature for receiving a pin of an HVAC controller, a terminal block location for receiving an end of a wire, and a transformation pin-out adapted to couple to a printed wire board, with the contact mating feature, the terminal block location, and the transformation pin-out being electrically coupled together. In one embodiment, an HVAC controller is modified to allow a controller adapted for use with a single fuel system to control dual fuel system.

11 Claims, 4 Drawing Sheets

OTHER PUBLICATIONS

Honeywell, "7800 SERIES, Q7800A,B 22-Terminal Universal Wiring Subbase," Product Data, pp. 1-8, Nov. 1991.
Honeywell, "7800 SERIES S7830 Expanded Annunciator," Product Data, pp. 1-12, Jun. 1992.
Honeywell, "7800 SERIES EC7810A, EC7820A Relay Modules," Specification Data, pp. 1-8, Mar. 1998.
Honeywell, "The Burner Control Family for Your Boiler, Your Baker, Your Hot Water Maker," 7800 SERIES, pp. 1-2, Dec. 1995.

* cited by examiner

FUNCTION TRANSFORM SUB-BASE

FIELD OF THE INVENTION

The present invention is related to the field of HVAC control systems, and more specifically to methods, devices and systems for coupling HVAC controllers to HVAC systems.

BACKGROUND OF THE INVENTION

For a number of reasons, including increased comfort expectations, air quality concerns, and increased energy efficiency concerns, the design and control of heating, ventilation and air conditioning (HVAC) systems is continually becoming more complex. Designing controllers for each specific application is sometimes difficult due to the unique characteristics and needs of individual buildings and clients. However, designing a custom or application specific controller for each individual HVAC system can be quite expensive. For some controllers, such as combustion controllers, there also can be fairly rigorous safety requirements, both in terms of hardware and software, that must be met before the controllers can be brought to market. Satisfying these requirements can be particularly burdensome if multiple custom or application specific controllers are to be offered. It would be advantageous, therefore, to provide devices and methods that allow an HVAC controller to be adapted for use in a variety of systems and/or applications. In some cases, this may reduce the burden of satisfying the various safety requirements, at least relative to providing a number of customer or application specific controllers. In addition, this may allow OEMs to purchase just a single controller, and then adapt the controller for use in a variety of systems and/or applications without sacrificing safety.

SUMMARY OF THE INVENTION

The present invention includes a transform sub-base that has a plurality of terminals for selectively receiving a plurality of pins of an HVAC controller at selected contact mating feature locations. The transform sub-base preferably also includes a plurality of transformation pin-outs, wherein each transformation pin-out is coupled to one of the terminals of the transform sub-base. In some embodiments, a number of terminal block locations are also provided for receiving HVAC device wires, wherein the terminal block locations are preferably coupled to the terminals of the transform sub-base.

In one illustrative embodiment, the output(s) of an HVAC controller, which plugs into the sub-base via the contact mating features, may be taken either directly from the sub-base at the terminal block locations via wires installed by the installer, or from the one or more corresponding transformation pin-outs. The transformation pin-outs are preferably adapted to form a connection with a printed wiring board. The signals at each of the transformation pin-outs can be made available at other locations on the printed wiring board via one or more traces, as desired. Other components mounted on the printed wiring board can be used to process the signals provide to/from the HVAC controller, which may allow an HVAC controller to be adapted for a variety of systems and/or applications.

In one example, the function of a single fuel HVAC controller may be adapted to a duel fuel HVAC system via an illustrative transform sub-base of the present invention. In this example, when the single fuel HVAC controller initiates a call for heat, additional logic provided on the printed wiring board may direct the call for heat to an appropriate fuel valve of a dual fuel HVAC system. Many other examples are also contemplated, some of which are further described below.

DETAILED DESCRIPTION OF SEVERAL EMBODIMENTS

The following detailed description should be read with reference to the drawings. The drawings depict several illustrative embodiments of the present invention and are not intended to limit the scope of the invention.

Although much of the following description is written in terms of working with a heating device or devices, cooling devices such as air conditioners and heat pumps may also be used in conjunction with HVAC controllers and the present invention. The present invention may be used to provide scalability and flexibility to relatively simple HVAC controllers. For example, the present invention may help a single fuel source HVAC controller to control a multiple fuel source HVAC systems. Many other examples are also contemplated.

Figure 1:
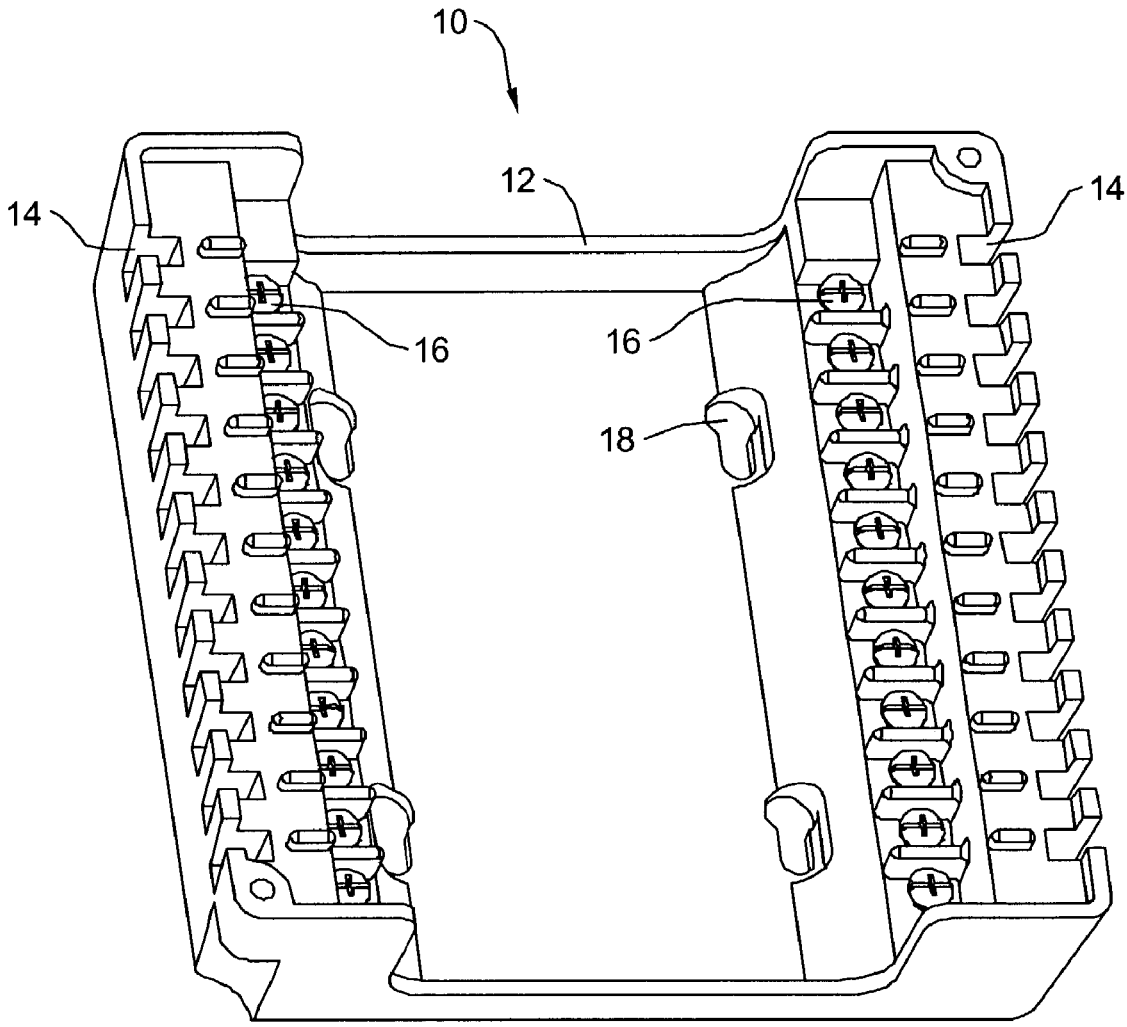
Fig.1 (Prior Art)
FIG. 1 is a perspective view of a prior art sub-base.

FIG. 1 illustrates a perspective view of a prior art sub-base. The prior art sub-base 10 includes a body 12 which includes a plurality of slots 14 and a plurality of screws 16. Each of the plurality of screws 16 is adapted to receive a wire that may be coupled to an HVAC sensor, device, or other input or output of an HVAC system. Each of the slots 14 includes a contact mating feature (not shown) that receives a pin from an HVAC controller, when the controller is plugged into the sub-base from the top side. Each contacting mating feature is electrically connected to a corresponding screw 16, thus providing an electrical connection between each pin of the HVAC controller and a corresponding screw 16 of the sub-base.

The prior art sub-base 10 may also include a number of mounting holes 18, which may be used to mount the sub-base 10 to a secure location such as the interior of a power box or a wall. In use, a technician typically mounts the prior art sub-base 10 using the mounting holes 18, and then secures appropriate wires from the HVAC system to selected ones of the screws 16. Once the sub-base is mounted and coupled to the sensors or devices of an HVAC system, a controller is plugged onto the contact mating features of the sub-base 10 via the plurality of slots 14 making an electrical connection. If the controller fails or for some reason a new controller is to be used, the controller may be easily removed from the sub-base 10 by simply pulling it out of engagement with the contact mating features within the slots 14. This may allow the replacement of the HVAC controller without necessarily requiring rewiring of the HVAC system.

Figure 2:
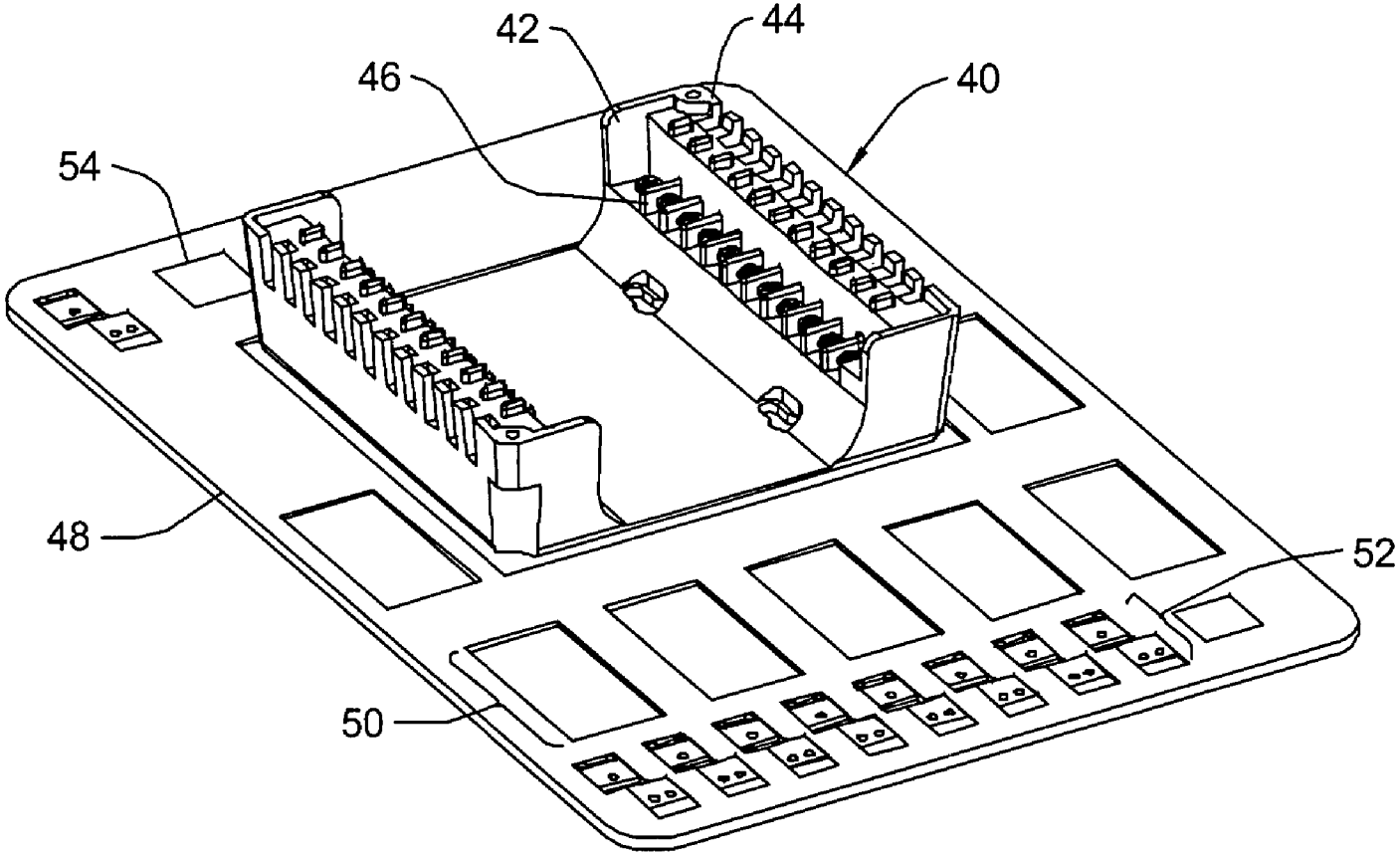
FIG. 2 is a perspective view of an illustrative embodiment of the present invention.

FIG. 2 is a perspective view of an illustrative embodiment of the present invention. A sub-base 40 is illustrated having a body 42, a plurality of slots 44 each with a contact mating feature 74 (see FIG. 3), and in some cases, a plurality of screws 46. Like above, the contact mating features 74 within the slots 44 are adapted to receive the pins of an HVAC controller. When provided, the screws 46 are electrically connected to corresponding contacting mating features 74, and are adapted to receive wires going to and/or from any of a variety of HVAC devices, sensors, and control apparatuses.

The illustrative sub-base 40 is also shown coupled to a printed wire board 48. To do so, the sub-base 40 may include a number of transformation pin-outs which are used to couple at least selected contacting mating features 74 within slots 44 of the sub-base to selected traces on the printed wire board 48, or to other circuitry or devices, as desired. The printed wire board 48 may include a number of electronic and/or mechanical devices, as desired. In the illustrative example of FIG. 2, a number of relays 50 are shown, as well as several terminals 52 for coupling with one or more HVAC devices, sensors and/or control apparatuses. Additional circuitry 54, such as a processor or other logic or circuitry, may also be provided on the printed wire board 48 for providing additional functionality and/or control. In some cases, the additional circuitry 54 and/or relays 50 may be used to effectively alter the basic input and/or output function.

In one example, a pin from an HVAC controller may be used to supply an on/off signal to a gas valve of a single-fuel system. The same HVAC controller may be used to operate a multi-fuel system which may, for example, bum a first fuel and a second fuel. In this example, a selector (not shown) may provide a selector signal to selected relays 50 for selecting between the two different fuels. The output of the selector may be used to control which of the relays 50 conveys the on/off signal provided by the single fuel HVAC controller to the corresponding fuel valve through a corresponding terminal 52. It is contemplated that the relays 50 could be replaced with any number of electric switches, gates, electromechanical devices, logic, etc. In another example, additional circuitry 54 may be used to, for example, shift an input signal level provided by a sensor, average the input signal levels received by a number of sensors, or perform any number of other functions, before providing the processed signal to the sub-base and ultimately to the HVAC controller.

Figure 3:
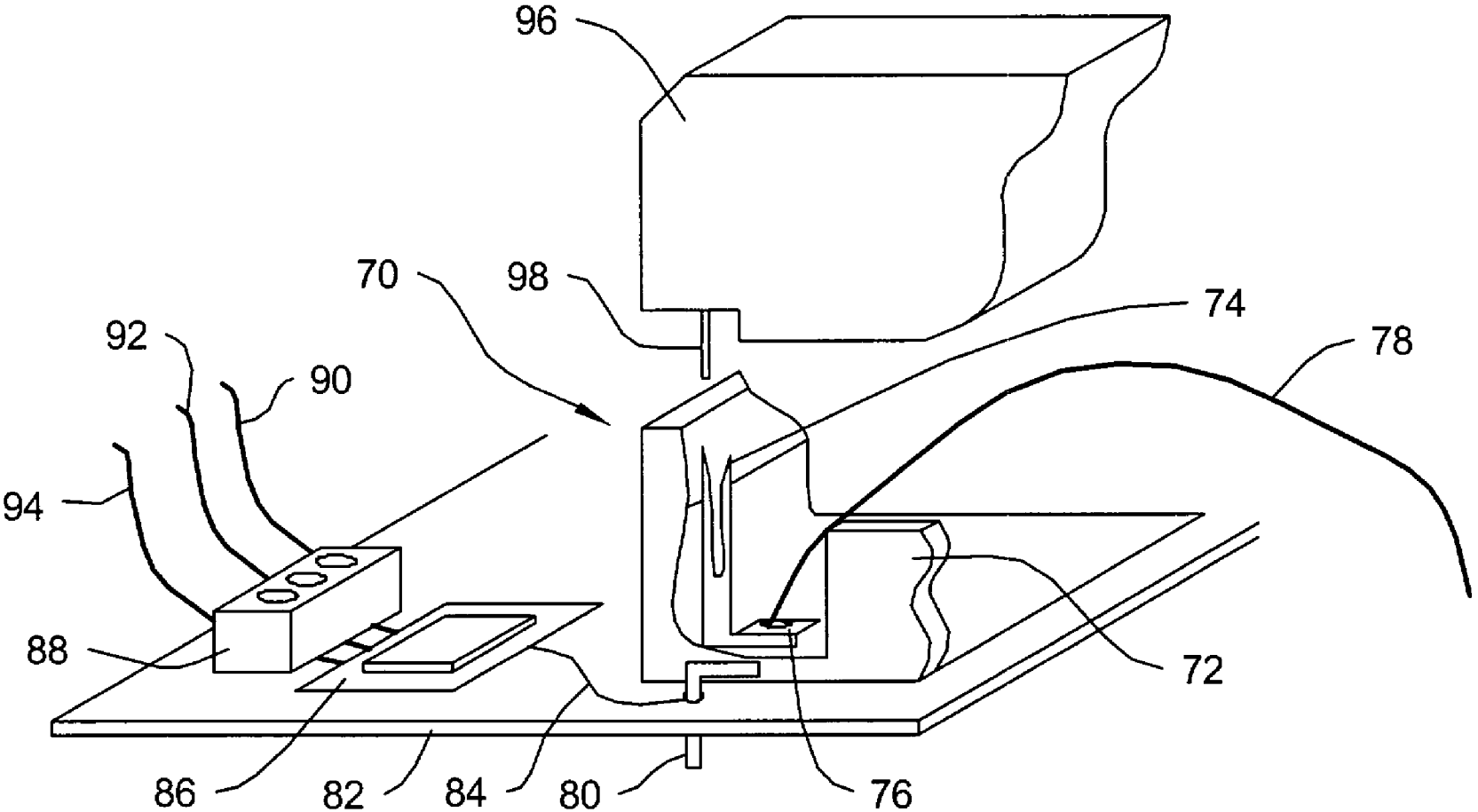
FIG. 3 is a partial cut-away expanded view showing an illustrative embodiment or the present invention.

FIG. 3 is a partial cut-away expanded view showing an illustrative embodiment of the present invention and expounds on several details. The embodiment of FIG. 3 includes a sub-base 70 that has a body 72 with a contact mating feature 74 for receiving a pin of an HVAC controller. Each contact mating feature 74 is preferably provided in a slot, such as a slot 44 of FIG. 2. One or more transformation pin-outs 80 are also preferably provided. Each transformation pin-out 80 is preferably electrically connected to one or more contact mating feature 74. In some embodiments, a terminal block location 76 is provided for receiving the end of a wire 78. Each of the terminal block locations 76 may include a screw, and is preferably electrically connected to one or more contact mating features 74. Each of the terminal block locations 76 may also be coupled to an HVAC sensor, device, or other input or output of an HVAC system, or one or more contacts or pads of the printed wire board 82 or components 86 or 88 mounted on the printed wire board.

During use, and in the illustrative embodiment, the transformation pin-outs 80 are coupled to a printed wire board 82 with a number of traces 84. In the illustrative embodiment, trace 84 couples transformation pin-out 80 to a contact pad of processing block 86. The processing block 86 is shown coupled by further traces to a terminal block 88 for receiving two external inputs 90, 92 and a third input/output 94. In the illustrative embodiment, input/output 94 may be either an input or an output that is coupled directly or indirectly to controller 96 via a controller pin 98 that is inserted into a contact mating feature 74 of the sub-base body 72.

Though not explicitly shown in FIG. 3, the sub-base 70 may include a number of distinct contact mating features 74, terminal block locations 76 and/or transformation pin-outs 80. For example, these may be provided in two parallel rows of discrete groupings, though many other configurations are contemplated, depending on the application. In some embodiments, the sub-base 70 may not include a contact mating feature 74, a terminal block location 76 and a transformation pin-out 80 at every discrete location, but rather some subset is included.

During use, and in one illustrative embodiment, the controller 96 of FIG. 3 may generate an output signal calling for heat, and the call for heat may be coupled (depending perhaps on the values of the external inputs 90, 92) to the input/output line 94, which in turn may be coupled to a heat source such as an HVAC system. For example, if a controller 96 is adapted to receive a pilot flame signal and a thermostat signal and use those signals to control whether a call for heat is issued, the sub-base 70, printed wire board 82 and/or processing block 86 may be used to help allow additional signals such as signals 90 and 92 to be used in the control of the HVAC system. For example, if a carbon monoxide (CO) sensor is provided, the CO sensor may have an output that is received at an external input 90 and used to prevent a call for heat and from causing a burner to ignite and create additional CO if unsafe CO levels are sensed.

In an example for a multi-zone heating system, a single thermostat signal could be provided to the controller 96, and the external modifiers 90, 92 could be used to determine which of several ventilation control circuits are activated such that only certain zones receive temperature modifying air. The external modifiers 90, 92 could be thermostat outputs from multiple thermostats, and could provide control signals for controlling which of several zones are ventilated by being coupled to damper controls. Further, the three terminals 90, 92, 94 could be treated together to provide a single thermostat signal (or an average signal) to the controller 96 such that if a signal is received at any terminal 90, 92, 94 calling for heat, the controller 96 would receive a single signal calling for heat. The damper control need not be directed to or controlled by the HVAC controller itself, though such may be the case. Many other transformations functions can be used, depending on the particular circumstances and desired application.

Figure 4:
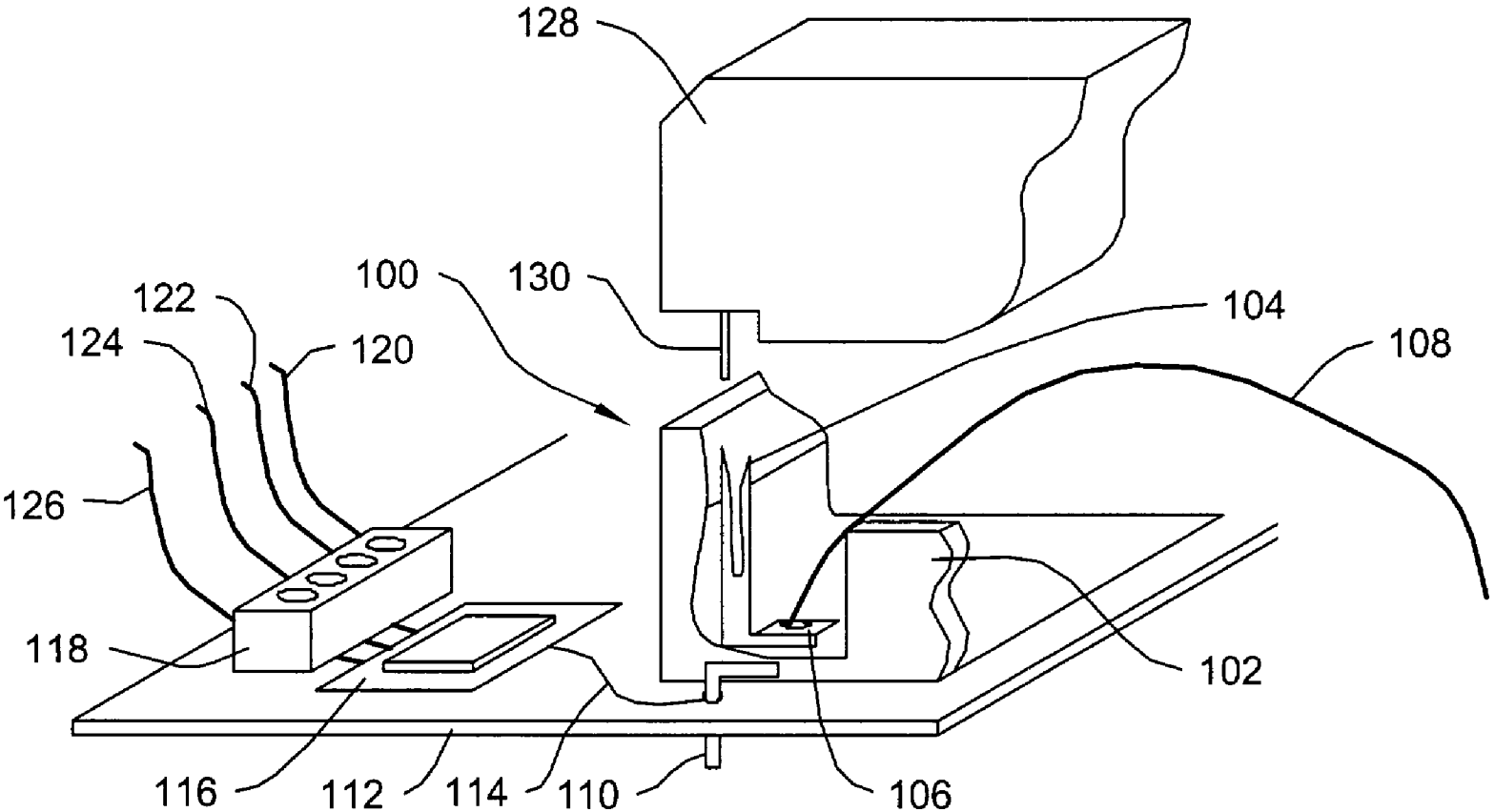
FIG. 4 is another partial cut-away expanded view showing another illustrative embodiment of the present invention.

FIG. 4 is another partial cut-away expanded view showing another illustrative embodiment of the present invention. In FIG. 4, a sub-base 100 is shown having a body 102 partially cut away to reveal a contact mating feature 104 adapted to receive a pin 130 of an HVAC controller 128. One wire terminal 106 is also shown, although there would be others in many embodiments. The wire terminal 106 is preferably electrically connected to one or more contact mating features 104, and is adapted to receive a wire such as wire 108. A number of transformation pin-outs 110 may also be provided. Each transformation pin-out 110 is preferably electrically connected to one or more contact mating features 104, and is adapted to couple into a printed wire board 112. In the illustrative embodiment, each contact mating feature 104 is electrically coupled to a single wire terminal 106 and a single transformation pin-out 110, but this is not required in all embodiments.

In the illustrative embodiment, the printed wire board 112 preferably includes one or more traces 114, which couple selected transformation pin-outs 110 to circuitry 116, which in turn, is coupled to a terminal block having several terminals 120, 122, 124, 126. While only one contact mating feature 104, wire terminal 106 and transformation pin-out 110 is illustrated in FIG. 4, it is contemplated that any number of such groups may be provided on the same sub-base 100, and further that other sub-groupings may also be provided if desired.

In use, the sub-base 100 may be coupled to the printed wire board 112 as illustrated, as well as to a controller 128 having a number of pins 130. The sub-base 100 may include other mechanical devices or mechanisms for coupling to or securing a controller 128 such as clips, slots or screws. In some embodiments, a wire 108 may be used or excluded depending on the particular application. The terminal block 118 may be modified as desired, for example, to include any number of input/output terminals for attachment to any number of devices. Further, the printed wire board 112 may be provided with additional devices such as, for example, light emitting diodes or other indicator mechanisms for indicating the status of an HVAC system, a memory for recording HVAC system events, selectors or switches for altering system functions, antennae for receiving or transmitting wireless signals, timing or clocking devices, etc.

The illustrative embodiment of FIG. 4 may be used to, for example, provide multiplexing of an output from the controller 128. The terminal block 118 may have a first input terminal 120, a second input terminal 122, a first output terminal 124 and a second output terminal 126. The output of the controller 128 at the pin 130 may be directed in accordance with the multiplexing input signals of the first and second input terminals 120, 122. The following is an illustrative output table:

| First input terminal 120 | Second input terminal 122 | First output terminal 124 | Second output terminal 126 |
|---|---|---|---|
| Low | Low | Low | Low |
| High | Low | =Pin 130 | Low |
| Low | High | Low | =Pin 130 |
| High | High | =Pin 130 | =Pin 130 |

A different multiplexing scheme can also be used, if desired. Also, the signals supplied or taken from the terminal block 118 may be generated or received by any number of devices, depending on the applications.

Those skilled in the art will recognize that the present invention may be manifested in a variety of forms other than the specific embodiments described and contemplated herein. Accordingly, departures in form and detail may be made without departing from the scope and spirit of the present invention as described in the appended claims.

What is claimed is:

1. A transform sub-base for an HVAC controller, wherein the HVAC controller includes a plurality of terminals, the transform sub-base comprising:

a plurality of contact mating feature for receiving at least some of the plurality of terminals of the HVAC controller;

at least one transformation pin-out electrically coupled to at least one of the plurality of contact mating features, wherein the at least one transformation pin out includes one or more ridgid pins adapted to make an electrical connection to a printed wire board; wherein the transform sub-base is free from integrated circuitry connected electrically to the pluarlity of contact mating features and the at least one transformation pin-out.

2. A transform sub-base according to claim 1 further comprising:

a plurality of terminal block locations, each electrically coupled to one or more contact mating features.

3. The transform sub-base of claim 2 wherein each of the terminal block locations is adapted to secure a wire.

4. The transform sub-base of claim 1 wherein each of the contact mating features is adapted to releasably receive a corresponding pin of the HVAC controller.

5. A transform sub-base for an HVAC controller, wherein the HVAC controller includes a plurality of terminals, the transform sub-base comprising:

a body;

a plurality of contact mating features formed into one side of the body forreceiving at least some of the plurality of terminals of the HVAC controller;

a plurality of terminal block locations formed into the body, each terminal block location being electrically coupled to one or more of the contact mating features; and a plurality of transformation pin-outs, wherein the pin-outs are ridgid pins, each electrically coupled to at least one ofthe plurality of contact mating features, the plurality of transformation pin-outs formed into an opposite side of the body as the plurality of contact mating features and each being adapted to make an electrical connection to a printed wire board; wherein the transform sub-base is free from intergrated circuitry connected electrically to the pluarlity of contact mating features and the plurality of transformation pin-outs.

6. A method for using an HVAC controller, the method comprising:

providing a transform sub-base including a plurality of terminals, each terminal having a contact mating feature for receiving a pin of an HVAC controller, terminal block location for receiving an end of a wire, and a ridgid transformation pin-out adapted to couple to a printed wire board, wherein the contact mating feature is electrically coupled to the terminal block location and the transformation pin-out; wherein the transform sub-base is free from intergrated circuitry connected electrically to the contact mating feaures and the ridgid transformation pin-outs;

providing a printed wire board having circuitry for customizing the function of the HVAC controller;

coupling the transform sub-base to the printed wire board using the ridgid transformation pin-out; and coupling the HVAC controller to the transform sub-base.

7. The method of claim 6 further comprising:

providing an electric circuit on the printed wire board, the electric circuit having a first output controlling whether a first fuel valve is enabled and a second output controlling whether a second fuel valve is enabled, the circuit configured so that when the first output is enabling, the second output is not enabling.

8. The method of claim 7 further comprising coupling a selected transformation pin-out of the transform sub-base to the electric circuit, the selected transformation pin-out controlling whether the first output or the second output can be enabled.

9. The method of claim 8 further comprising coupling a selection signal to the electric circuit, the selection signal controlling which of the first output or the second output is enabled.

10. The method of claim 9 wherein the selection signal is generated from a switch coupled to the printed wire board.

11. A sub-base for an HVAC controller, wherein the HVAC controller includes a plurality of terminals, the sub-base comprising:

a body;

a plurality of contact mating features formed into one side of the body for receiving at least some of the plurality of terminals of the HVAC controller;

a plurality of terminal block locations formed into the body, at least some of the terminal block location being electrically coupled to one or more of the contact mating features, wherein at least selected terminal block locations are adapted to secure a wire; and a plurality of pin-outs, wherein the pin-outs are rigid pins, at least some of which are electrically coupled to at least one of the plurality of contact mating features, the plurality of pin-outs extending out from another side of the body as the plurality of contact mating features and each being adapted to make an electrical connection to a printed wire board; wherein the sub-base is free from integrated circuitry connected electrically to the plurality of contact mating features and the plurality of pin-outs.

* * * * *